US007784282B2

(12) United States Patent
Masso et al.

(10) Patent No.: US 7,784,282 B2
(45) Date of Patent: Aug. 31, 2010

(54) FUEL INJECTOR AND METHOD OF ASSEMBLING THE SAME

(75) Inventors: James Purdue Masso, Greenville, SC (US); Monty Harned, Sugar Land, TX (US); Shashishekara Sitharamarao Talya, Houston, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/191,036

(22) Filed: Aug. 13, 2008

(65) Prior Publication Data

US 2010/0037613 A1 Feb. 18, 2010

(51) Int. Cl.
*F02C 1/00* (2006.01)

(52) U.S. Cl. ..... 60/740; 239/124; 239/125; 239/128

(58) Field of Classification Search ..... 60/736, 60/740, 39.12; 239/124, 125, 128, 132, 132.1, 239/132.3, 132.5, 533.2, 584, 585.5
See application file for complete search history.

(56) References Cited

U.S. PATENT DOCUMENTS

| | | | | |
|---|---|---|---|---|
| 2,838,105 | A | 6/1958 | Eastman et al. | |
| 3,874,592 | A * | 4/1975 | Buschmann et al. | 239/132.3 |
| 4,371,387 | A * | 2/1983 | Scholes | 65/118 |
| 4,443,228 | A * | 4/1984 | Schlinger | 48/86 R |
| 4,445,444 | A * | 5/1984 | Espedal | 110/261 |
| 4,491,456 | A | 1/1985 | Schlinger | |
| 4,527,997 | A * | 7/1985 | Espedal | 48/86 R |
| 4,743,194 | A * | 5/1988 | Stellaccio | 431/23 |
| 4,752,303 | A * | 6/1988 | Materne et al. | 48/202 |
| 5,941,459 | A * | 8/1999 | Brooker et al. | 239/397.5 |
| 6,162,266 | A * | 12/2000 | Wallace et al. | 48/197 R |
| 6,276,611 | B1 | 8/2001 | Brooker et al. | |
| 6,513,317 | B2 | 2/2003 | Arar et al. | |
| 6,519,945 | B2 | 2/2003 | Arar et al. | |
| 6,755,355 | B2 * | 6/2004 | Whittaker | 239/132 |
| 2004/0226297 | A1 * | 11/2004 | Griffin et al. | 60/737 |
| 2006/0231645 | A1 * | 10/2006 | Chan | 239/424 |
| 2007/0095046 | A1 * | 5/2007 | Wallace | 60/39.12 |
| 2007/0234729 | A1 | 10/2007 | West et al. | |
| 2008/0175769 | A1 | 7/2008 | Goller et al. | |

OTHER PUBLICATIONS

Patent Cooperation Treaty, International Search Report for Application No. PCT/US2009/049196, Feb. 2, 2010, 5 pages.

* cited by examiner

*Primary Examiner*—Michael Cuff
*Assistant Examiner*—Phutthiwat Wongwian
(74) *Attorney, Agent, or Firm*—Armstrong Teasdale LLP

(57) ABSTRACT

A fuel injector is provided. The fuel injector includes a nozzle, a cooling assembly, and a tip coupled to the nozzle. The tip includes a base including a cooling channel defined therein, a first transition member extending outwardly from the base and in flow communication with the cooling channel, and a second transition member extending outwardly from the base and in flow communication with the cooling channel, wherein the base, the first transition member, and the second transition member are formed integrally together. The tip is configured to couple to the cooling assembly to channel a flow of cooling fluid through the cooling channel via the first transition member and the second transition member.

14 Claims, 5 Drawing Sheets

FUEL INJECTOR AND METHOD OF ASSEMBLING THE SAME

BACKGROUND OF THE INVENTION

The field of this disclosure relates generally to integrated gasification combined-cycle (IGCC) power generation systems, and more specifically to a fuel injector for use with an IGCC power generation system.

Known gasifiers convert a mixture of fuel, air or oxygen, steam, coal, and/or limestone into partially oxidized gas, often referred to as "syngas." In many known power generation systems, the syngas is supplied to the combustor of a gas turbine engine to power a generator that supplies electrical power to a power grid. In some known power generation systems, exhaust from the gas turbine engine is supplied to a heat recovery steam generator that generates steam for driving a steam turbine, such that power generated by the steam turbine also drives an electrical generator that provides electrical power to the power grid.

The fuel, air or oxygen, steam, and/or limestone are injected into the gasifier from separate sources through a fuel injector that couples the fuel sources to a fuel nozzle. In many known power generation systems, fuel injector nozzles extend partially into the gasifier and are thus subjected to extreme mechanical and/or thermal stresses. Some fuel injector assemblies rely on a cooling channel formed within a fuel injector nozzle tip to direct a flow of cooling fluid through the tip. In addition, a cooling coil may be coupled in flow communication with the nozzle tip to provide the flow of cooling fluid through the cooling channel to enhance cooling of the fuel injector nozzle. However, in at least some nozzles, the transition between the fuel injector tip and the cooling coil may be prone to failure when exposed to the extreme mechanical and thermal stresses produced within the gasifier.

BRIEF DESCRIPTION OF THE INVENTION

In one aspect, a method of assembling a fuel injector is provided. The method includes providing a fuel injector tip that includes a base that includes a cooling channel, a first transition member that extends outwardly from the base, and a second transition member that extends outwardly from the base, wherein the cooling channel, the first transition member, and the second transition member are formed integrally together. The method also includes coupling the fuel injector tip to a fuel injector and coupling a cooling assembly to the fuel injector to channel a flow of cooling fluid through the cooling channel via the first transition member and the second transition member.

In another aspect, a fuel injector is provided. The fuel injector includes a nozzle, a cooling assembly, and a tip coupled to the nozzle. The tip includes a base including a cooling channel defined therein, a first transition member extending outwardly from the base and in flow communication with the cooling channel, and a second transition member extending outwardly from the base and in flow communication with the cooling channel, wherein the base, the first transition member, and the second transition member are formed integrally together. The tip is configured to couple to the cooling assembly to channel a flow of cooling fluid through the cooling channel via the first transition member and the second transition member.

In another aspect, a power generation system is provided. The power generation system includes a gas turbine engine, a gasifier coupled to the gas turbine engine, and a fuel injector extending at least partially into the gasifier. The fuel injector includes a nozzle. The system also includes a cooling assembly coupled to the fuel injector, and a tip coupled to the nozzle. The tip includes a base including a cooling channel defined therein, a first transition member extending outwardly from the base and in flow communication with the cooling channel, and a second transition member extending outwardly from the base and in flow communication with the cooling channel. The base, the first transition member, and the second transition member are formed integrally together. The tip is configured to couple to the cooling assembly to channel a flow of cooling fluid through the cooling channel via the first transition member and the second transition member.

DETAILED DESCRIPTION OF THE INVENTION

Figure 1:
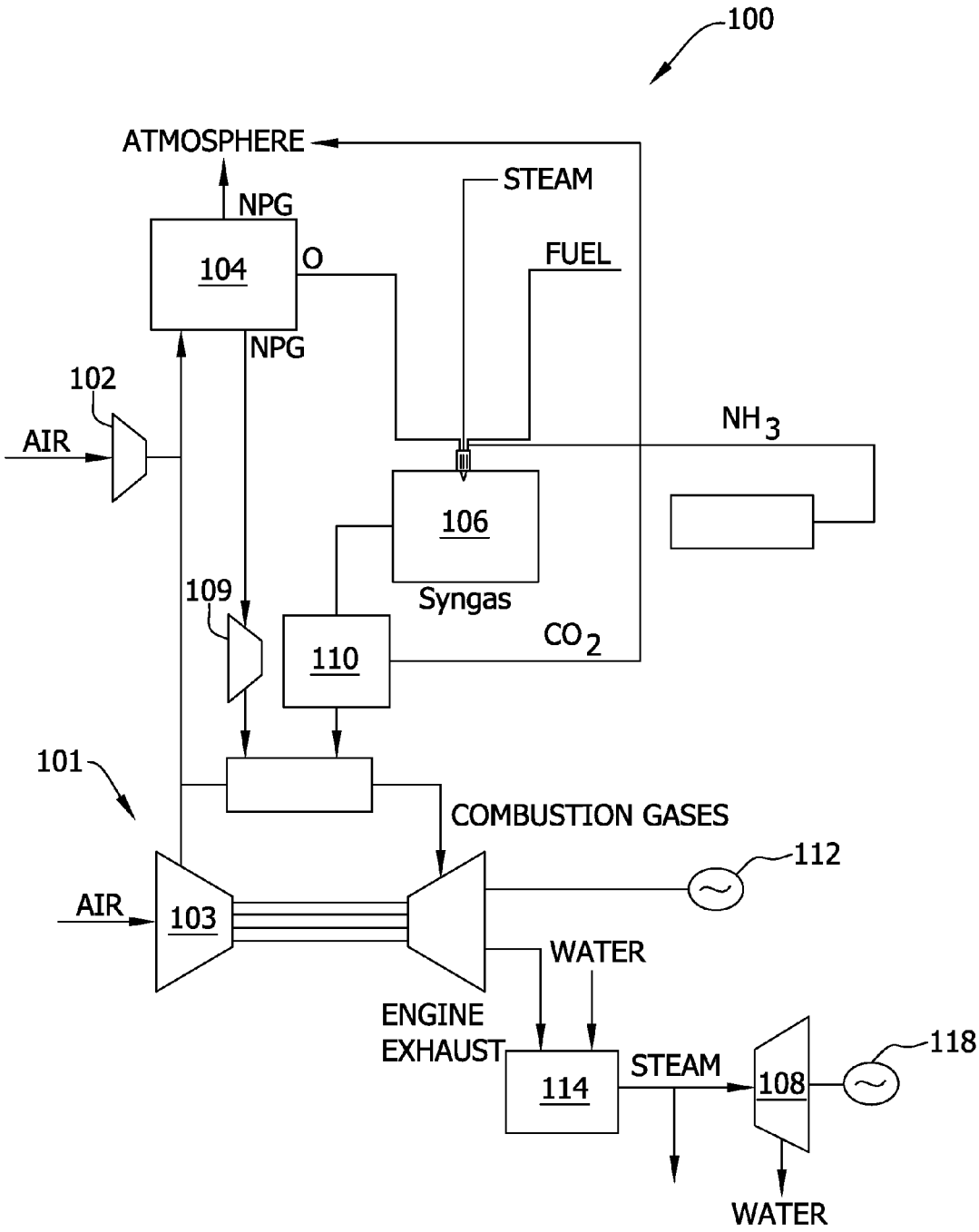
FIG. 1 is a schematic diagram of an exemplary integrated gasification combined-cycle (IGCC) power generation system.

FIG. 1 is a schematic diagram of an exemplary integrated gasification combined-cycle (IGCC) power generation system 100. IGCC system 100 generally includes a main air compressor 102, an air separation unit 104 coupled in flow communication with compressor 102, a gasifier 106 coupled in flow communication with air separation unit 104, a gas turbine engine 101 coupled in flow communication with gasifier 106, and a steam turbine 108. In operation, main air compressor 102 compresses ambient air. The compressed air is channeled to air separation unit 104. In addition, or in the alternative, to main air compressor 102, compressed air from a gas turbine engine compressor 103 may be supplied to air separation unit 104. Air separation unit 104 uses the compressed air to generate oxygen for use by gasifier 106. More specifically, air separation unit 104 separates the compressed air into separate flows of oxygen and a gas by-product, sometimes referred to as a "process gas." The process gas generated by air separation unit 104 includes nitrogen and will be referred to herein as "nitrogen process gas." The nitrogen process gas may also include other gases such as, but not limited to, oxygen and/or argon. For example, in some embodiments, the nitrogen process gas includes between about 95% and about 100% nitrogen. The oxygen flow is channeled to gasifier 106 for use in generating partially combusted gases, referred to herein as "syngas," for use by gas turbine engine 101 as fuel, as described below in greater detail. In IGCC system 100, at least some of the nitrogen process gas flow, a by-product of air separation unit 104, is vented to the atmosphere. Moreover, in IGCC system 100, some of the nitrogen process gas flow is injected into a combustion zone within gas turbine engine combustor 103 to facilitate controlling emissions of engine 101 and, more specifically, to facilitate reducing a combustion temperature and reducing a nitrous oxide emission level of engine 101. IGCC system 100 may also include a compressor 109 for compressing the nitrogen process gas flow before the nitrogen gas flow is injected into the combustion zone.

Gasifier 106 converts a mixture of fuel, the oxygen supplied by air separation unit 104, steam, and/or limestone into an output of syngas for use by gas turbine engine 101. Although gasifier 106 may use any fuel, in IGCC system 100, gasifier 106 uses coal, petroleum coke, residual oil, oil emulsions, tar sands, and/or other similar fuels. In IGCC system 100, the syngas generated by gasifier 106 includes carbon dioxide. The syngas generated by gasifier 106 may be cleaned in a clean-up device 110 before being channeled to gas turbine engine combustor 103 for combustion thereof. Carbon dioxide may be separated from the syngas during clean-up and vented to the atmosphere. The power output from gas turbine engine 101 drives a generator 112 that supplies electrical power to a power grid. Exhaust gas from gas turbine engine 101 is supplied to a heat recovery steam generator 114 that generates steam for driving steam turbine 108. Power generated by steam turbine 108 drives an electrical generator 118 that provides electrical power to the power grid, and steam from heat recovery steam generator 114 is supplied to gasifier 106 for generating the syngas.

Figure 2:
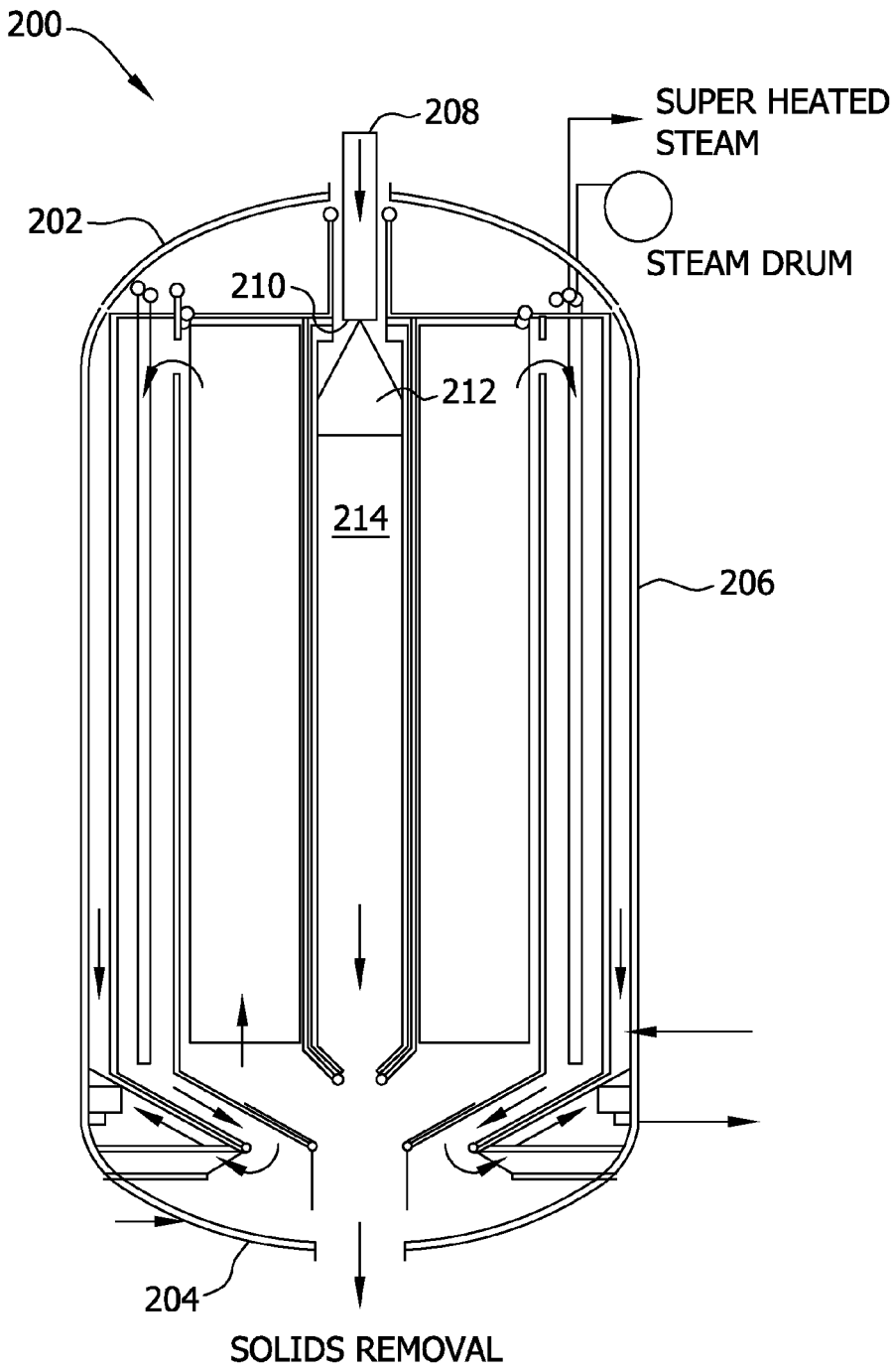
FIG. 2 is a schematic view of an exemplary advanced solids removal gasifier that may be used with the system shown in FIG. 1.

FIG. 2 is a schematic view of an exemplary embodiment of an advanced solids removal gasifier 200 that may be used with system 100 (shown in FIG. 1). In the exemplary embodiment, gasifier 200 includes an upper shell 202, a lower shell 204, and a substantially cylindrical vessel body 206 extending therebetween. A fuel injector 208 penetrates upper shell 202 to enable a flow of fuel to be channeled into gasifier 200. Fuel injector 208 includes a nozzle 210 that discharges the fuel in a predetermined pattern 212 into a combustion zone 214 defined in gasifier 200. Fuel flows through one or more passages (not shown in FIG. 2) defined in fuel injector 208 and exits fuel injector 208 through nozzle 210. The fuel may be mixed with other substances prior to entering nozzle 210, and/or may be mixed with other substances after being discharged from nozzle 210. For example, the fuel may be mixed with fines recovered from a process of system 100 prior to entering nozzle 210, and/or the fuel may be mixed with an oxidant, such as air or oxygen, at nozzle 210 or downstream from nozzle 210.

Figure 3:
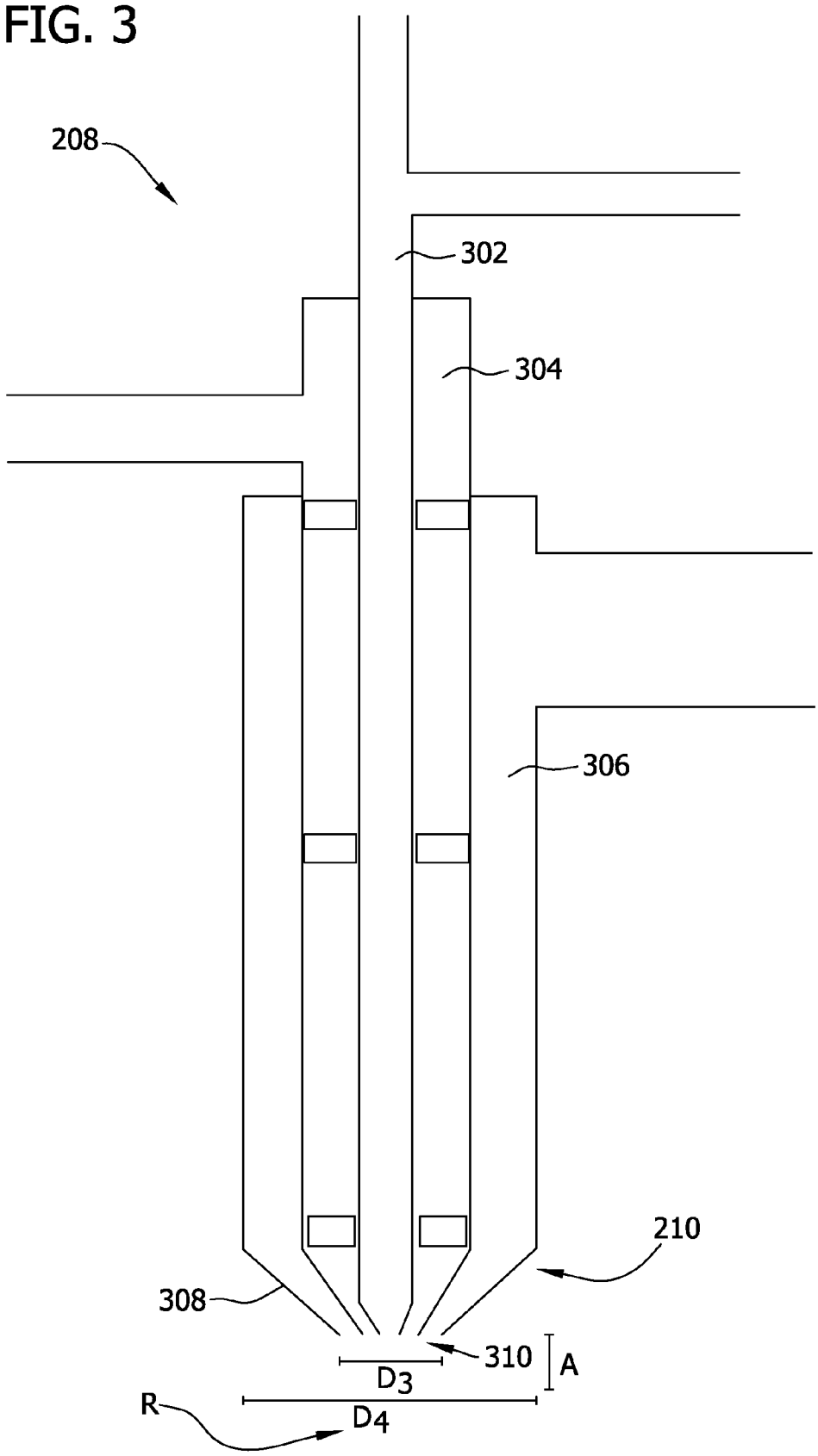
FIG. 3 is an enlarged cross-sectional view of a fuel injector that may be used with the gasifier shown in FIG. 2.

FIG. 3 is an enlarged cross-sectional view of fuel injector 208. In the exemplary embodiment, fuel injector 208 includes a central fuel stream conduit 302 and concentrically-aligned, annular fuel stream conduits 304 and 306 that converge at an outlet end 308 of nozzle 210 to form an outlet orifice 310. During operation, fuel injector 208 provides a continuous fuel stream of carbonaceous fuel through conduit 304 and primary and secondary oxidizer flows through conduits 302 and 306. In an alternative embodiment, conduit 304 provides a liquid-phase slurry of solid carbonaceous fuel such as, for example, a coal-water slurry. The oxygen containing gas and carbonaceous slurry streams merge together at a predetermined distance A beyond outlet orifice 310 of fuel injector nozzle 210, but in close proximity to nozzle outlet end 308, to form a reaction zone R, wherein the emerging fuel stream is ignited. Self ignition of the fuel stream is enhanced by a breakup or an atomization of the merging fuel streams discharged from nozzle outlet orifice 310. Such atomization promotes product reaction and heat development that are necessary for the gasification process. As a result, reaction zone R defined in close proximity to outlet end 308 is characterized by intense heat, with temperatures ranging from approximately 2400° F. to 3000° F., for example. To propel the streams through reaction zone R and a distance D away from nozzle outlet orifice 310, the streams travel through conduits 302, 304, and 306 at a relatively high velocity.

Figure 4:
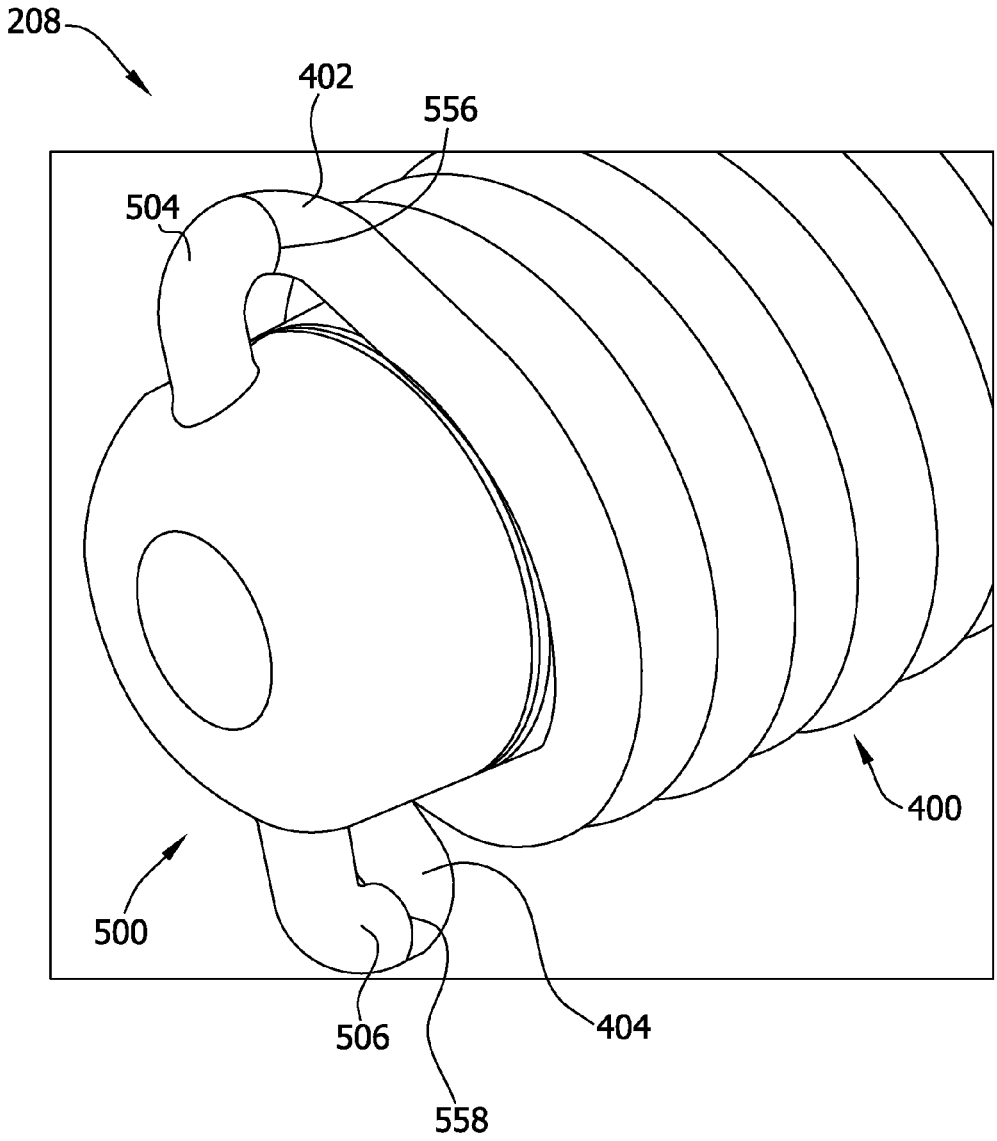
FIG. 4 is a partial perspective view of the fuel injector shown in FIG. 3 with a fuel injector tip attached thereto.

FIG. 4 is a partial perspective view of fuel injector 208 with a fuel injector tip 500 coupled thereto to facilitate cooling fuel injector 208. A cooling assembly 400 is coupled in flow communication with fuel injector tip 500. In the exemplary embodiment, cooling assembly 400 includes a first fluid transfer line 402 (e.g., a first hollow cooling coil) for use in channeling a cooling fluid into fuel injector tip 500 and a second fluid transfer line 404 (e.g., a second hollow cooling coil) for use in receiving a cooling fluid discharged from fuel injector tip 500. In one embodiment, first and second fluid transfer lines 402 and 404 are intertwined together and/or are wrapped about at least a portion of fuel injector 208. In another embodiment, only one of first fluid transfer line 402 and second fluid transfer line 404 wraps about at least a portion of fuel injector 208. Alternatively, cooling assembly 400 may include any suitable arrangement of fluid transfer lines that enables cooling assembly 400 to function as described herein.

Figure 5:
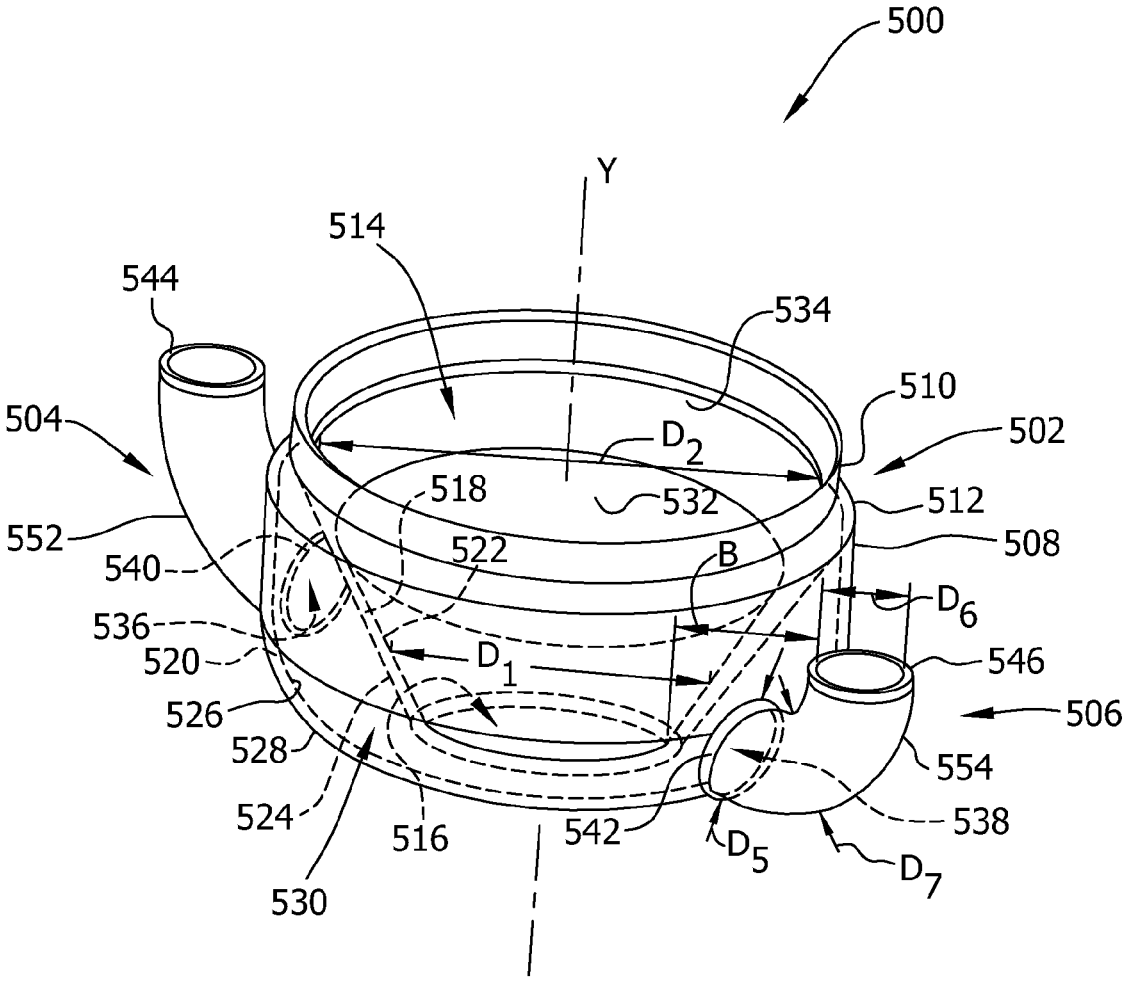
FIG. 5 is a perspective view of the fuel injector tip shown in FIG. 4.

FIG. 5 is an alternative perspective view of fuel injector tip 500. In the exemplary embodiment, fuel injector tip 500 includes a housing 502, a first transition member 504 extending from housing 502, and a second transition member 506 extending from housing 502. In the exemplary embodiment, first transition member 504 and second transition member 506 extend from opposite sides of housing 502. Alternatively, first transition member 504 and second transition member 506 may extend from any location on housing 502 that enables fuel injector tip 500 to function as described herein. In the exemplary embodiment, fuel injector tip 500 is formed using a molding process (e.g., a casting process), such that housing 502, first transition member 504, and second transition member 506 are formed integrally together. As used herein, the term "formed integrally together" refers to a structure formed as one piece (e.g., via a casting process), and does not refer to separately formed pieces that are joined together (e.g., via a welding process). In the exemplary embodiment, fuel injector tip 500 is fabricated from a material that is capable of withstanding temperatures greater than about 2,000° F. For example, in one embodiment, fuel injector tip 500 is fabricated from a material that is capable of withstanding temperatures at or exceeding about 2,400° F.

Housing 502 is generally annular and includes a base 508, a mounting flange 510, and an angular lip 512 that extends between base 508 and mounting flange 510. In the exemplary embodiment, base 508, mounting flange 510, and angular lip 512 are each substantially coaxially aligned with respect to a centerline axis Y extending transversely through housing 502. Housing 502 defines an injector tip inlet 514 and an injector tip outlet 516. Injector tip inlet 514 is sized to receive at least a portion of fuel injector tip 500 therein.

Base 508 includes an inner wall 518 and an outer wall 520. Inner wall 518 includes an inner surface 522 and an outer surface 524, and outer wall 520 includes an inner surface 526 and an outer surface 528. In the exemplary embodiment, base 508 is hollow, such that outer wall inner surface 526 and inner wall outer surface 524 define a cooling channel 530 therebetween. Outer wall outer surface 528 has a generally parabolic cross-section in the exemplary embodiment. Alternatively, outer wall outer surface 528 may be formed with any suitable contour that enables base 508 to function as described herein. A first portion 532 of inner wall inner surface 522 is generally frusto-conical, and a second portion 534 of inner wall inner surface 522 is generally cylindrical. In an alternative embodiment, inner wall inner surface 522 may have any suitable shape that enables fuel injector tip 500 to function as described herein. In the exemplary embodiment, inner wall inner surface 522 circumscribes outlet orifice 310 (shown in FIG. 3) such that a flow path for fuel discharged from outlet orifice 310 is defined when fuel injector tip 500 is coupled to fuel injector 208 (shown in FIG. 3). More specifically, in the exemplary embodiment, inner wall inner surface 522 has a first diameter $D_1$ that is smaller than a diameter $D_3$ (shown in FIG. 3) of outlet orifice 310. The decreased diameter $D_1$ of surface 522 facilitates funneling fuel discharged from outlet orifice 310 into gasifier 106 (shown in FIG. 2). Inner wall inner surface 522 has a second diameter $D_2$ that is larger than a diameter $D_4$ (shown in FIG. 3) of outlet end 308 (shown in FIG. 3) to enable fuel injector tip 500 to couple to fuel injector 208 (shown in FIG. 3).

In an exemplary embodiment, cooling channel 530 is annular and is sized to circumscribe outlet orifice 310. Alternatively, cooling channel 530 may have any shape, and/or may only partially circumscribe outlet orifice 310. Outer wall 520 defines a cooling channel inlet aperture 536 and a cooling channel outlet aperture 538 that is located generally diametrically opposite inlet aperture 536. In the exemplary embodiment, cooling fluid enters channel 530 through inlet aperture 536 and exits cooling channel 530 through outlet aperture 538. In another embodiment, apertures 536 and 538 are adjacent to one another. Alternatively, apertures 536 and 538 may be defined anywhere along outer wall 520 that enables fuel injector tip 500 to function as described herein.

In an exemplary embodiment, either first fluid transfer line 402 (shown in FIG. 4) and/or second fluid transfer line 404 (shown in FIG. 4) has a limited flexion, such that either first transition member 504 and/or second transition member 506 are coupled to fluid transfer lines 402 and/or 404, respectively, using transition members 504 and/or 506 that have complex bending geometries. To facilitate coupling fuel injector tip 500 in flow communication with cooling assembly 400 (shown in FIG. 4), first transition member 504 is formed integrally with outer wall 520 at a first transition region 540, is in flow communication with cooling channel inlet aperture 536, and extends to a first connection end 544. Second transition member 506 is formed integrally with outer wall 520 at a second transition region 542, is in flow communication with cooling channel outlet aperture 538, and extends to a second connection end 546. In the exemplary embodiment, either first transition member 504 and/or second transition member 506 is generally tubular and extends arcuately from base 508, in any desired direction, to first connection end 544 or second connection end 546, respectively, in such a manner that facilitates a smooth transition with cooling assembly 400.

In an exemplary embodiment, as fuel is discharged through fuel injector tip 500, an uneven distribution of thermal energy in the fuel may induce disproportionate, dynamic thermal stresses that vary in location and intensity to fuel injector tip 500. In the exemplary embodiment, to facilitate generating a uniform flow distribution of cooling fluid throughout cooling channel 530, either first transition member 504 and/or second transition member 506 is formed with an internal diameter $D_5$ at transition region 540 and/or 542, respectively, that is larger than an internal diameter $D_6$ defined at connection end 544 and/or 546, respectively. In one embodiment, either first transition region 540 and/or second transition region 542 tapers as it extends away from base 508 such that either first transition member 504 and/or second transition member 506 intersects outer wall inner surface 526 at an oblique angle that facilitates a smooth transition of cooling fluid flow from transition member 504 and/or 506 into and/or out of cooling channel 530. In another embodiment, either first transition region 540 and/or second transition region 542 tapers as it extends away from base 508, and a respective intermediate portion 552 or 554 of either first transition member 504 and/or second transition member 506 has a substantially constant internal diameter $D_7$ between first transition region 540 and first connection end 544 and/or between second transition region 542 and second connection end 546, respectively. In yet another embodiment, either first transition member 504 and/or second transition member 506 has a substantially constant internal diameter $D_5$, $D_6$, or $D_7$ therethrough. Alternatively, either first transition member 504 and/or second transition member 506 may have any internal diameter that enables fuel injector tip 500 to function as described herein. As used herein, the term diameter is defined as a distance across any cross-sectional shape (e.g., a rectangle, a triangle, etc.) and is not limited to only describing a distance across circular or elliptical cross-sectional shapes.

In the exemplary embodiment, fuel injector tip 500 is coupled to fuel injector 208 and cooling assembly 400 to facilitate cooling fuel injector 208. Specifically, injector tip inlet 514 receives a portion of fuel injector 208 therein, such that fuel injector 208 is positioned adjacent to inner wall inner surface 522 to direct a flow of fuel discharged from fuel injector 208 through fuel injector tip 500 and into gasifier 106. When fuel injector 208 is positioned within fuel injector tip 500, first transition member 504 is coupled to first fluid transfer line 402 at a first joint 556 (shown in FIG. 4), and second transition member 506 is coupled to second fluid transfer line 404 at a second joint 558 (shown in FIG. 4). As such, fuel injector tip 500 channels a flow of cooling fluid therethrough from first transition member 504, through inlet aperture 536, through cooling channel 530, through outlet aperture 538, and through second transition member 506, thereby facilitating reducing an operating temperature of fuel injector 208 via conductive heat transfer between fuel injector 208 and cooling fluid flowing through cooling channel 530.

In an exemplary embodiment, either first joint 556 and/or second joint 558 are formed using a bonding process (e.g., welding, brazing, etc.). Alternatively, first joint 556 and/or second joint 558 may be formed using any suitable manufacturing process that enables fuel injector tip 500 to function as described herein. In the exemplary embodiment, because first and second transition members 504 and 506 are formed integrally with base 508 and extend away from outlet orifice 310, first joint 556 and/or second joint 558 are spaced a distance B outwardly from outlet orifice 310 when fuel injector tip 500 is coupled to fuel injector 208. As such, oxidation, thermal stresses, and/or other potential sources of joint failure that may be induced to joints 556 and/or 558 are facilitated to be reduced.

The methods and systems described herein enable a fuel injector tip to be coupled to a fuel injector in a manner that facilitates cooling the fuel injector. The methods and systems described herein also enable a fuel injector tip to interface with a fuel injector cooling assembly to achieve a substantially uniform flow distribution of cooling fluid throughout the fuel injector tip, thus reducing oxidation and/or thermal stresses induced to the fuel injector. The methods and systems described herein further facilitate increasing a reliability of a fuel injector tip and thus extending a useful life of the fuel injector, while also reducing a cost associated with manufacturing the fuel injector tip.

Exemplary embodiments of a fuel injector and a method of assembling the same are described above in detail. The methods and systems described herein are not limited to the specific embodiments described herein, but rather, components of the methods and systems may be utilized independently and separately from other components described herein. For example, the methods and systems described herein may have other applications not limited to practice with IGCC power generation systems, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A fuel injector comprising:

a nozzle comprising an outlet orifice having a first diameter;

a cooling assembly comprising:

a first fluid transfer line in flow communication with a first cooling coil; and a second fluid transfer line in flow communication with a second cooling coil, at least one of said first cooling coil and said second cooling coil circumscribing a portion of said fuel injector; and a tip coupled to said nozzle, said tip comprising:

a base comprising:

a cooling channel defined therein by a substantially cylindrical outer wall and a frustoconical inner wall;

an inner surface that circumscribes said nozzle outlet orifice, said inner surface having a second diameter that is smaller than said outlet orifice first diameter, said base sized to receive said nozzle therein; and an outer surface;

a first transition member in flow communication with said cooling channel and said first fluid transfer line; and a second transition member in flow communication with said cooling channel and said second fluid transfer line, wherein said base, said first transition member, and said second transition member are formed integrally together, each of said first transition member and said second transition member extend outward from said base outer surface, and each comprises a first end, a second end, and a body extending therebetween, each of said transition member first end is coupled to said base outer surface such that each of said first transition member body and said second transition member body extend outward therefrom, said tip configured to couple to said cooling assembly to channel a flow of cooling fluid through said cooling channel via said first transition member and said second transition member.

2. A fuel injector in accordance with claim 1, wherein at least said first transition member extends arcuately outwardly from said base.

3. A fuel injector in accordance with claim 1, wherein at least said first transition member comprises a transition region and a connection end, wherein an internal diameter at said transition region is larger than an internal diameter at said connection end.

4. A fuel injector in accordance with claim 1, wherein at least said first transition member comprises a transition region that tapers away from said base.

5. A fuel injector in accordance with claim 1, wherein said base, said first transition member, and said second transition member are formed using a casting process.

6. A fuel injector in accordance with claim 4, wherein an inner surface of said transition region intersects an inner surface of said base at an oblique angle.

7. A power generation system comprising:

a gas turbine engine;

a gasifier coupled to said gas turbine engine;

a fuel injector extending at least partially into said gasifier, said fuel injector comprising a nozzle, wherein said nozzle comprises an outlet orifice having a first diameter;

a cooling assembly coupled to said fuel injector comprising:

a first fluid transfer line in flow communication with a first cooling coil; and a second fluid transfer line in flow communication with a second cooling coil, at least one of said first cooling coil and said second cooling coil circumscribing a portion of said fuel injector; and a tip coupled to said nozzle, said tip comprising:

a base comprising:

a cooling channel defined therein by a substantially cylindrical outer wall and a frustoconical inner wall;

an inner surface that circumscribes said nozzle outlet orifice, said inner surface having a second diameter that is smaller than said outlet orifice first diameter, said base sized to receive said nozzle; and an outer surface;

a first transition member in flow communication with said cooling channel and said first fluid transfer line; and a second transition member in flow communication with said cooling channel and said second fluid transfer line, wherein said base, said first transition member, and said second transition member are formed integrally together, each of said first transition member and said second transition member extend outward from said base outer surface, and each comprises a first end, a second end, and a body extending therebetween, each of said transition member first end is coupled to said base outer surface such that each of said first transition member body and said second transition member body extend outward therefrom, said tip configured to couple to said cooling assembly to channel a flow of cooling fluid through said cooling channel via said first transition member and said second transition member.

8. A system in accordance with claim 7, wherein at least said first transition member extends arcuately outwardly from said base.

9. A system in accordance with claim 7, wherein at least said first transition member comprises a transition region and a connection end, wherein an internal diameter at said transition region is larger than an internal diameter at said connection end.

10. A system in accordance with claim 7, wherein at least said first transition member comprises a transition region that tapers away from said base.

11. A system in accordance with claim 7, wherein said base, said first transition member, and said second transition member are formed using a casting process.

12. A system in accordance with claim 7, wherein said first transition member comprises a first connection end coupled to said first fluid transfer line at a first joint, said second transition member comprises a second connection end coupled to said second fluid transfer line at a second joint, wherein said first joint and said second joint are spaced a distance outwardly from said base to facilitate reducing a thermal stress application to at least one of said first joint and said second joint.

13. A system in accordance with claim 7, wherein at least one of said first transition member and said second transition member extends arcuately outwardly from said base to facilitate coupling said first transition member to said first cooling coil and said second transition member to said second cooling coil.

14. A system in accordance with claim 10, wherein an inner surface of said transition region intersects an inner surface of said base at an oblique angle.

* * * * *